US007810470B2

(12) United States Patent
Scharfenberg

(10) Patent No.: US 7,810,470 B2
(45) Date of Patent: Oct. 12, 2010

(54) RETURN-FLOW ELECTRONIC FUEL PRESSURE REGULATOR

(75) Inventor: Robert E. Scharfenberg, St. Louis, MO (US)

(73) Assignee: Fluid Control Products, Inc., Litchfield, IL (US)

( * ) Notice: Subject to any disclaimer, the term of this patent is extended or adjusted under 35 U.S.C. 154(b) by 213 days.

(21) Appl. No.: 12/221,737

(22) Filed: Aug. 6, 2008

(65) Prior Publication Data

US 2010/0036584 A1 Feb. 11, 2010

(51) Int. Cl.
*F02M 1/00* (2006.01)

(52) U.S. Cl. ..... 123/446; 123/456; 123/502; 251/318

(58) Field of Classification Search ..... 123/456, 123/446, 495, 497, 502, 505, 511; 251/318–320, 251/333

See application file for complete search history.

(56) References Cited

U.S. PATENT DOCUMENTS

| | | | | |
|---|---|---|---|---|
| 3,168,102 | A | 2/1965 | Tyler et al. | |
| 3,919,981 | A | 11/1975 | Reddy | |
| 4,240,382 | A | 12/1980 | Reddy | |
| 4,278,061 | A | 7/1981 | Werner et al. | |
| 4,494,509 | A | 1/1985 | Long | |
| 4,539,960 | A * | 9/1985 | Cowles | 123/463 |
| 4,656,827 | A | 4/1987 | Puillet | |
| 4,711,216 | A | 12/1987 | Takeuchi et al. | |
| 4,926,829 | A | 5/1990 | Tuckey | |
| 4,951,636 | A | 8/1990 | Tuckey et al. | |
| 5,044,890 | A | 9/1991 | Loeffler et al. | |
| 5,120,201 | A | 6/1992 | Tuckey et al. | |
| 5,375,578 | A * | 12/1994 | Kato et al. | 123/516 |
| 5,619,972 | A * | 4/1997 | Kuenzli et al. | 123/497 |
| 5,623,907 | A * | 4/1997 | Cotton et al. | 123/456 |
| 5,848,583 | A | 12/1998 | Smith et al. | |
| 5,881,698 | A | 3/1999 | Tuckey et al. | |
| 6,298,731 | B1 | 10/2001 | Wade et al. | |
| 6,302,144 | B1 | 10/2001 | Graham et al. | |
| 6,622,707 | B2 | 9/2003 | Begley et al. | |
| 6,889,656 | B1 | 5/2005 | Rembold et al. | |
| 7,043,960 | B1 | 5/2006 | Lueck | |
| 7,185,634 | B2 | 3/2007 | Gardner et al. | |
| 7,188,610 | B2 | 3/2007 | Crary et al. | |
| 7,207,319 | B2 | 4/2007 | Utsumi | |
| 7,234,293 | B2 | 6/2007 | Yates et al. | |
| 2002/0020397 | A1 | 2/2002 | Begley et al. | |
| 2004/0172188 | A1 | 9/2004 | Bowling et al. | |
| 2005/0284448 | A1 | 12/2005 | Forgue et al. | |
| 2006/0185631 | A1 | 8/2006 | Fitzgerald | |
| 2006/0236981 | A1 | 10/2006 | Bickley | |

* cited by examiner

*Primary Examiner*—John T Kwon
(74) *Attorney, Agent, or Firm*—Gallop, Johnson & Neuman

(57) ABSTRACT

A return-flow electronic fuel pressure regulator for a fuel-injected engine fuel system is plumbed to the fuel rail and return line of the fuel system. The regulator includes a fill chamber connected to the fuel rail, a return chamber connected to the return line and a return reservoir disposed between the fill chamber and return chamber. Fuel flow from the fill chamber to the return reservoir is regulated via a diaphragm valve assembly. Fuel flow from the return reservoir to the return chamber is subject to restriction by an adjustable valve. Integral comparative pressure sensing means measures the fuel pressure drop between the return reservoir and return chamber. An electronic control module, preferably programmed to maintain a constant pressure drop between the return reservoir and return chamber, receives a signal from the pressure sensing means and outputs a power supply signal to the fuel pump to control pump speed.

12 Claims, 4 Drawing Sheets

RETURN-FLOW ELECTRONIC FUEL PRESSURE REGULATOR

CROSS REFERENCE TO RELATED APPLICATION

Not applicable.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to fuel systems for fuel injected engines and, more particularly, to a return-style fuel system utilizing a fuel pressure regulator.

BACKGROUND OF THE INVENTION

The typical motor vehicle utilizes electronic fuel injection (EFI) to deliver fuel into the engine. The fuel injectors (solenoid valves) are electrically connected to an engine control module that controls the amount of fuel entering the engine via control of the solenoid valves. By changing the dwell time of the valves, the amount of fuel entering the engine can be controlled. Fluctuations in engine performance and operating conditions can affect fuel pressure in the fuel system and hence the amount of fuel entering the engine. There are essentially two types of EFI systems, return-style and returnless, that are utilized to control fuel pressure. Typical return-style EFI systems rely on mechanical means to control fuel system delivery pressure by utilizing a return line from a fuel pressure regulator. A returnless system must rely upon electronic means for fuel pressure control. In this regard, the typical returnless system regulates fuel pressure by means of a fuel rail pressure sensor connected to electronics that can control fuel pump speed.

FIG. 1 depicts a return-style fuel system that is well known in the prior art. As shown in FIG. 1, fuel system 1 for an engine-driven vehicle having EFI includes a fuel tank 2, a fuel pump 3 and a fuel line 4 that delivers fuel from pump 3 to fuel injectors 5 disposed in fuel rail 6. Fuel line 4 includes fuel filter 7 and check valve 8. Fuel injectors 5 are mounted inside rail 6 and deliver fuel into engine intake manifold 10 carried by the engine 11. In a typical engine layout, nozzles (not shown) of the individual fuel injectors 5 are positioned adjacent to the fuel/air intake ports of the associated cylinders (not shown) of the engine 11.

In a return-style fuel system, fuel rail 6 is also connected to a bypass-style fuel pressure regulator 12, which is in turn connected to return line 13 leading back to fuel tank 2. Fuel pump 3 of the prior art return-style EFI fuel system is electrically driven and operates at a continuous (constant-speed) high flow rate while the bypass style fuel pressure regulator 12 returns unused fuel back to the tank. The engine management electronics adjust dwell time of the fuel injectors 5 in response to a variety of engine operating conditions such as intake manifold pressure, throttle position, engine speed or oxygen level. Typically the engine management electronics do not modulate dwell time based upon fuel pressure proper.

Hence, in a conventional return-style fuel system, fuel pressure is assumed to be at a proper level in the fuel rail 6 from the standpoint of setting fuel injector dwell times. The advantages of this fuel system include its simple operation and low cost, along with generally consistent fuel pressure that responds rapidly to sudden changes in demand for fuel flow to the engine. Disadvantages of this system include a relatively high current draw in the system leading to higher fuel temperatures, particularly in high flow applications.

The prior art fuel pressure regulator 12 operates to return over-pressurized, excess fuel to the tank. In this regard, fuel pressure regulator 12 acts like a gate and allows fuel to return to the tank only when a calibrated fuel rail pressure is reached. When this calibrated fuel pressure is reached, excess fuel will be permitted to return to the tank and fuel pressure in the fuel rail will be maintained. An example of a prior art fuel pressure regulator is depicted in FIG. 2. The prior art fuel pressure regulator includes an air chamber 17 and a fill chamber 14 that are separated from each other by a diaphragm 15. Air chamber 17 is plumbed to the engine intake manifold via vacuum line 25. Fill chamber 14 is fluidly connected to the fuel rail 6 via line 9. Fill chamber 14 and air chamber 17 are on opposites side of diaphragm 15. The fuel pressure regulator adjusts fuel pressure of the fill chamber 14 (fuel pressure applied to the fuel injector valves) to be higher than manifold negative pressure acting on the air chamber 17 by a predetermined degree (for example 2.5 atmosphere). In working operation movement (expansion) of the diaphragm is opposed by the force of spring 18. Spring 18 biases diaphragm 15, which has an integral valve 16 on valve seat 19. However, for simplicity of explanation purposes, when a difference between the fuel pressure and the manifold negative pressure becomes larger than a predetermined value, the diaphragm 15 is forced up. Integral valve 16 moves in cooperation with the diaphragm 15. As a result of the lifting of the valve, an opening degree of a throttle portion made up of the movable valve 16 and a valve seat 19 becomes large enough to allow excess fuel to enter return chamber 20 and flow back into the tank. By regulating fuel pressure in this fashion the prior art fuel pressure regulator maintains fuel pressure in fill chamber 14 at a constant pressure. This type of bypass style regulator is common on return-style fuel injection systems to allow changes in fuel pressure as a function of intake manifold pressure.

Further disadvantages exist in the prior art return-style fuel system having a constant speed fuel pump. In such a system the electric fuel pump operates at a constant speed above maximum engine demand. This action requires the maximum operating current to the fuel pump during all engineered fuel demand operating conditions. During extended periods of fuel pump operation, operating temperatures can get high enough to cause fuel pump cavitation and pump failure. High flow fuel systems develop even higher current draw and demand for higher current levels.

For high power (high flow) fuel systems, problems with heat build up are much more pronounced than with typical return-style OEM fuel systems. High current draw during idle and low cruise put extra strain on the vehicle charging system as well. To address these problems, electronic speed controllers are available to reduce the speed of the pump during low engine demand operating conditions. These controllers typically reduce the speed by a process referred to as pulse width modulation. This process reduces the incoming voltage to the fuel pump by limiting current draw. For example, the system will lower pump speed for low demand conditions such as typical street driving conditions and increase pump speed for racing conditions. Disadvantages of this type of system include the inability to have the fuel pump speed effectively engage as a function of engine demand without the use of electronic control. Additionally, in this type of system, changes in fuel pressure result when the speed of the fuel pump changes due to fuel pressure regulator performance (regulation slope). Also, these systems when employed with bypass style pressure regulators exhibit certain undesirable features. For example, these systems typically rely on the vehicle operator to manually set pump speed when operating at low speed, then increase speed during high engine demand.

SUMMARY OF THE INVENTION

This invention seeks to solve the foregoing problems associated with the return-style EFI fuel systems. The invention is directed to a return-flow electronic fuel pressure regulator and a fuel system comprising same. The fuel system comprises the novel return-flow electronic fuel pressure regulator described herein. The return-flow electronic fuel pressure regulator includes an adjustable flow restrictor between a return reservoir and a return chamber and integral comparative pressure sensing means to measure pressure drop created by the flow restrictor. In a preferred embodiment the comparative pressure sensing means is a single transducing element disposed between the regulator's return reservoir and return chamber. The transducing element, which could also be made up of one or more transducers, is adapted to receive pressure inputs from both chambers and output a unitary signal based upon a comparison of the input signals. This dual-input transducer is electrically connected to an ECM. The ECM, which may be part of the overall engine electronic control module, receives the transducer output and analyzes it against input data. In accordance with this analysis, the ECM outputs a signal to the pump to vary the pump speed. The output is maintained such that the reading of the transducer is constant therefore maintaining constant fuel flow through the return line. Hence, when measured pressure drop is too low, the ECM causes the fuel pump to speed up. When pressure drop readings are too high, fuel pump speed is decreased. This action allows a continuous and consistent return of fuel.

It is a further feature of the fuel system of the present invention that should the pump supply more fuel than that required by the operating engine, excess fuel is diverted from the engine by the pressure control system back to the fuel tank. However, in contrast to typical return-style systems, the returning fuel flow rate is relatively small. By virtue of the return-flow electronic fuel pressure regulator, the fuel system of the present invention can supply fuel from a tank to a fuel-injected engine in response to the fuel demand of the engine.

The return-flow electronic fuel pressure regulator of the present invention is designed for disposition between the fuel rail and return line of a return-style fuel system. A preferred embodiment pressure regulator of the present invention comprises a fuel intake chamber in fluid communication with the fuel rail and an air chamber in fluid communication with the engine air intake manifold. The embodiment sensorized fuel pressure regulator further comprises an expansible fill chamber in fluid communication with the fuel intake chamber. The fill chamber has at least one wall defined by a diaphragm that is part of a diaphragm assembly. The fill chamber and air chamber are on opposite sides of the diaphragm. The movement of the diaphragm assembly is acted upon by the pressure of fuel in the fill chamber and air pressure in the air chamber. The diaphragm assembly permits the flow of fuel from the expansible fuel fill chamber to a return reservoir based upon the difference in pressure of fuel in the fuel fill chamber and air pressure in the air chamber reaching a predetermined point. Fuel entering into the return reservoir passes through a restrictor valve and on into a return chamber. The return chamber is in fluid communication with the return line. The flow of fuel from the return reservoir to the return chamber is subject to restriction by an adjustable restricting valve. In the preferred embodiment, the return-flow electronic fuel pressure regulator further includes an integral dual-input pressure transducer measuring relative pressure of fuel in the return reservoir and the fuel in the return chamber (the pressure drop created by the flow restrictor) and outputs an electric signal based upon that relative pressure.

The present invention is further directed to a fuel system comprising the return-flow electronic fuel pressure regulator. The preferred embodiment fuel system comprises a fuel tank, a fuel pump for delivery of fuel from the fuel tank to a fuel rail, one or more fuel injectors communicating between the fuel rail and a return line from the fuel rail to the tank. The fuel system further includes the return-flow electronic fuel pressure regulator described above disposed in the return line between the fuel rail and the fuel tank. The regulator comprises a fuel intake chamber in fluid communication with the fuel rail and an air chamber in fluid communication with the engine air intake manifold. The regulator further comprises an expansible fill chamber in fluid communication with the fuel intake chamber. The fill chamber has at least one wall defined by a diaphragm that is part of a diaphragm assembly. The fill chamber and air chamber are on opposite sides of the diaphragm. The movement of the diaphragm assembly is acted upon by the pressure of fuel in the fill chamber and air pressure in the air chamber. The diaphragm assembly permits the flow of fuel from the expansible fuel fill chamber to the return reservoir based upon the difference in pressure of fuel in the fuel fill chamber and air pressure in the air chamber reaching a predetermined point. Fuel entering into the return reservoir passes through a restrictor valve an on into a return chamber. The return chamber is in fluid communication with the return line. The flow of fuel from the return reservoir to the return chamber is subject to restriction by an adjustable restricting valve. The preferred embodiment return-flow electronic fuel pressure regulator further includes an integral dual-input pressure transducer measuring relative pressure of fuel in the return reservoir and the fuel in the return chamber (the pressure drop created by the flow restrictor) and outputs an electric signal based upon that relative pressure.

The pressure transducer is designed for electrical connection to an ECM that analyzes those outputs and based upon that analysis outputs a power supply (speed controlling) signal to the fuel pump. The present invention fuel pressure regulator is novel in several respects. First it comprises an additional chamber, the return reservoir, between the diaphragm valve assembly and the restrictor valve. Second, it comprises integral comparative sensing means to measure the fuel pressure of the return reservoir in comparison to fuel pressure in the return chamber. By doing so, the comparative sensing means measures the pressure drop created by the regulator's restrictor valve. Third, the regulator outputs the measurement of the comparative sensing means as a signal to be received by an ECM for use in modulating pump speed. In contrast to the prior art fuel system that uses fuel rail pressure to control pump speed, the fuel system of the present invention uses the comparative measurement between the return reservoir and the return chamber as an input to control pump speed. Hence, in the present invention fuel system, it is the flow rate of returning fuel (that has been acted upon by the regulator's diaphragm assembly) that controls pump speed. The return-flow electronic fuel pressure regulator can be adapted for use in existing return-style fuel systems by reprogramming existing engine or fuel system control units to receive and analyze the pressure transducer output and output a pump control signal based upon same.

Other objects, features and advantages of the present invention will be readily appreciated, as the same becomes better understood, after reading the subsequent description taken in conjunction with the accompanying drawings.

DETAILED DESCRIPTION OF THE PREFERRED EMBODIMENT

Figure 1:
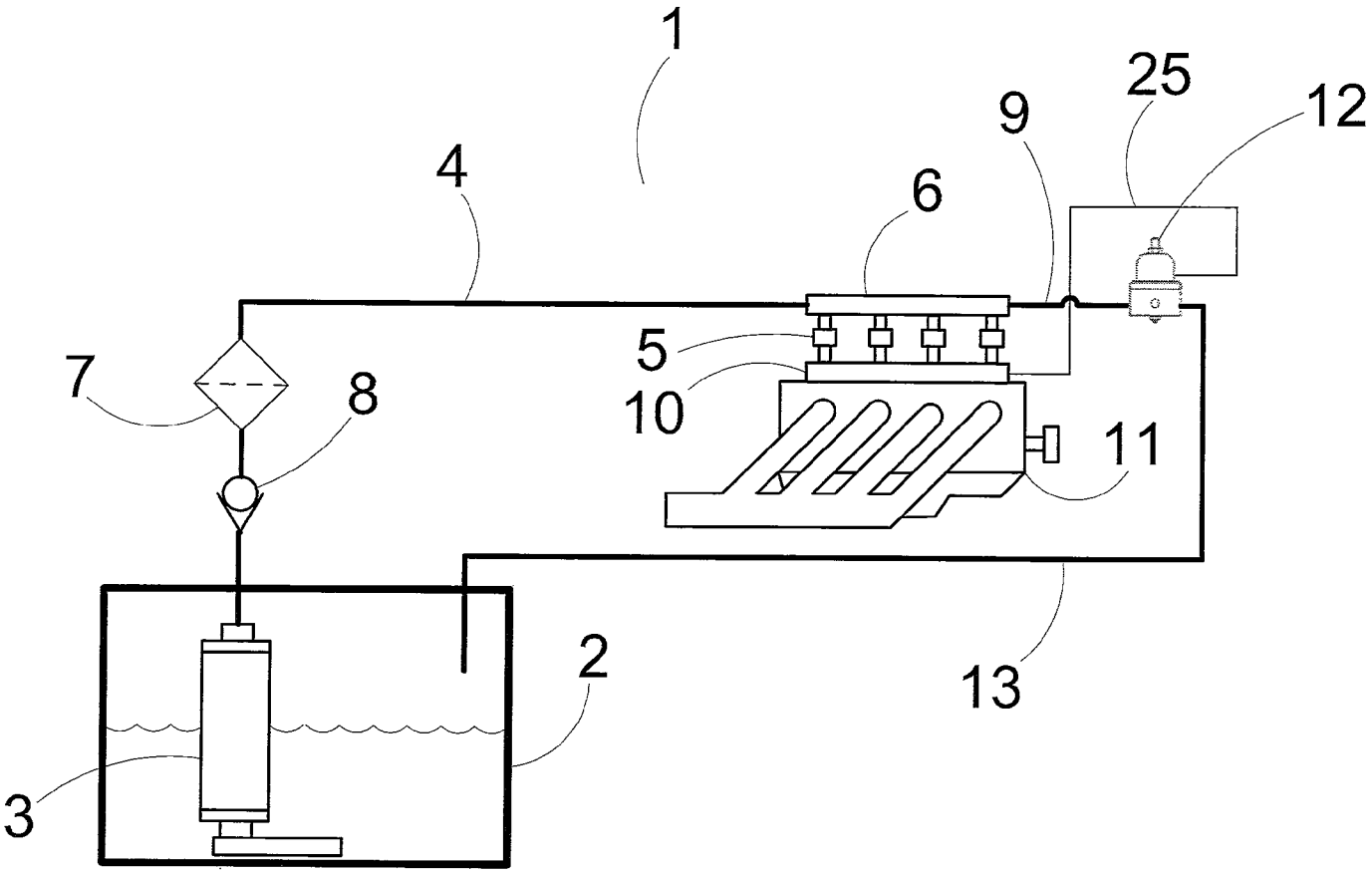
Prior Art FIG 1
FIG. 1 is a schematic diagram of a return-style prior art fuel system having a constant speed fuel pump.
Figure 2:
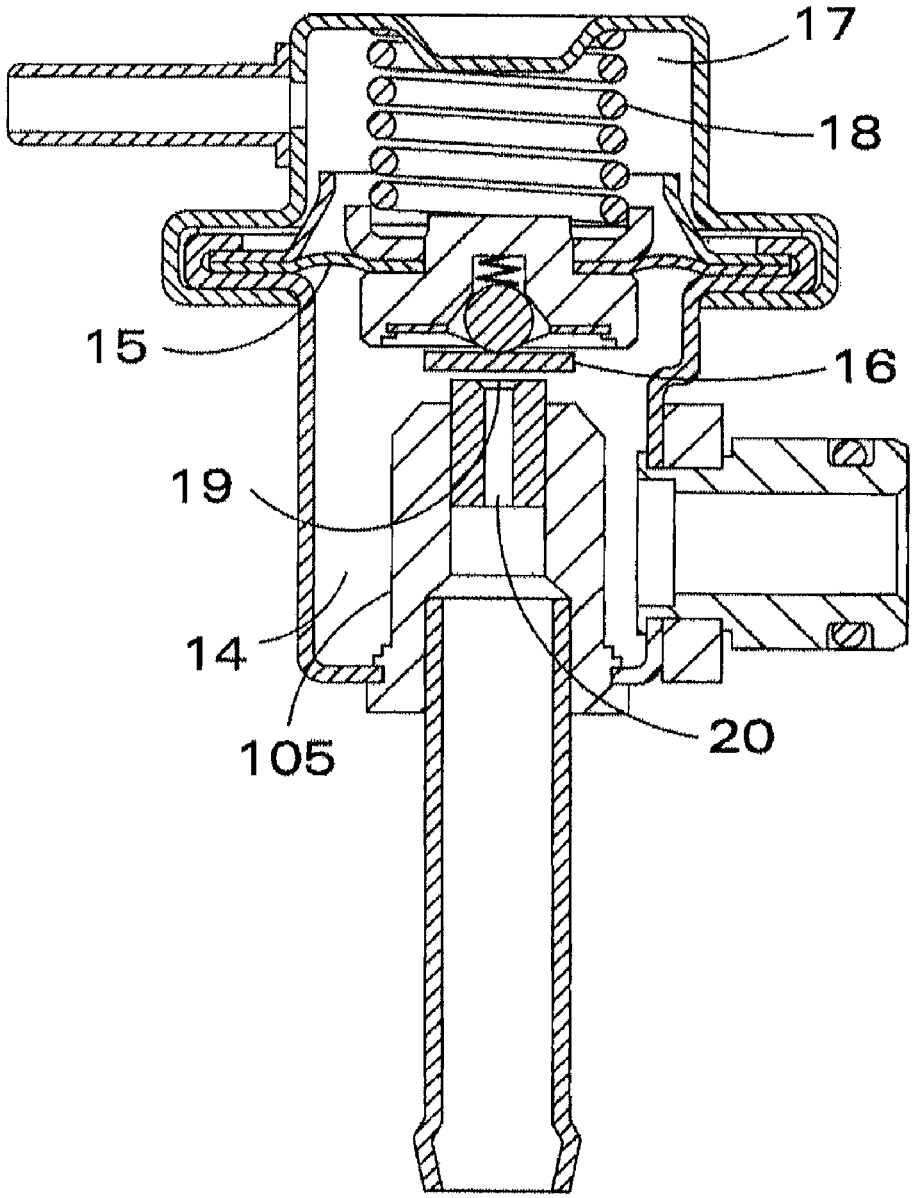
Prior Art FIG 2
FIG. 2 is a sectional elevation view of a prior art fuel pressure regulator.
Figure 3:
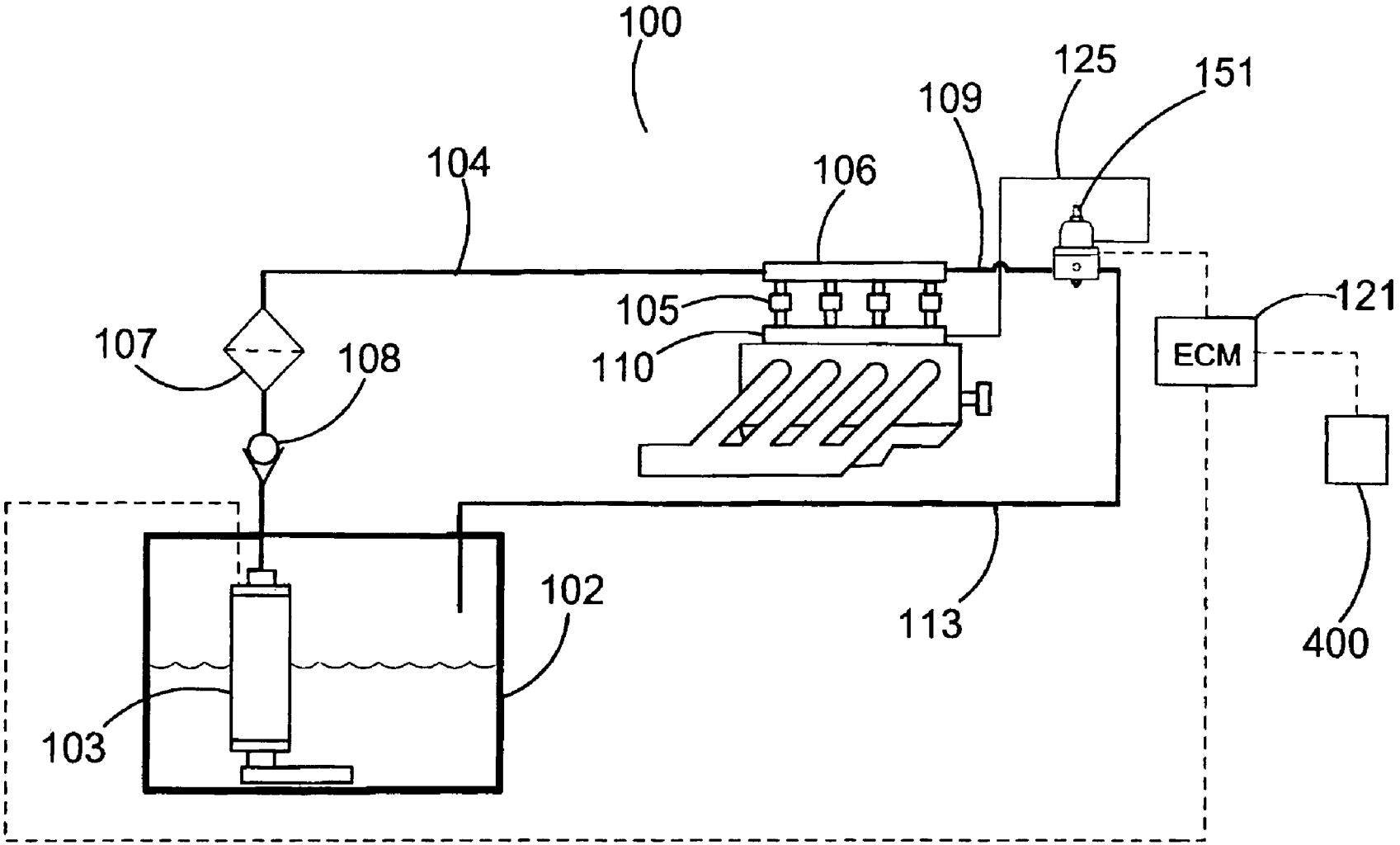
FIG. 3 is a schematic diagram of a preferred embodiment fuel system comprising the present invention return-flow electronic fuel pressure regulator.

FIG. 3 illustrates a preferred embodiment fuel delivery system 100 of the present invention for an engine with fuel injection. As shown in FIG. 3, fuel in tank 102 is pumped by the fuel pump 103 through check valve 108 and fuel filter 107 and through the fuel line 104 to engine fuel rail 106. Fuel injectors 105 deliver fuel from fuel rail 106 into engine intake manifold 110 to be used by the engine. Excess fuel from the fuel rail 106 is passed through fuel line 109 to the return-flow electronic fuel pressure regulator 151. Fuel exiting regulator 151 is returned back to tank 102 via return line 113.

Figure 4:
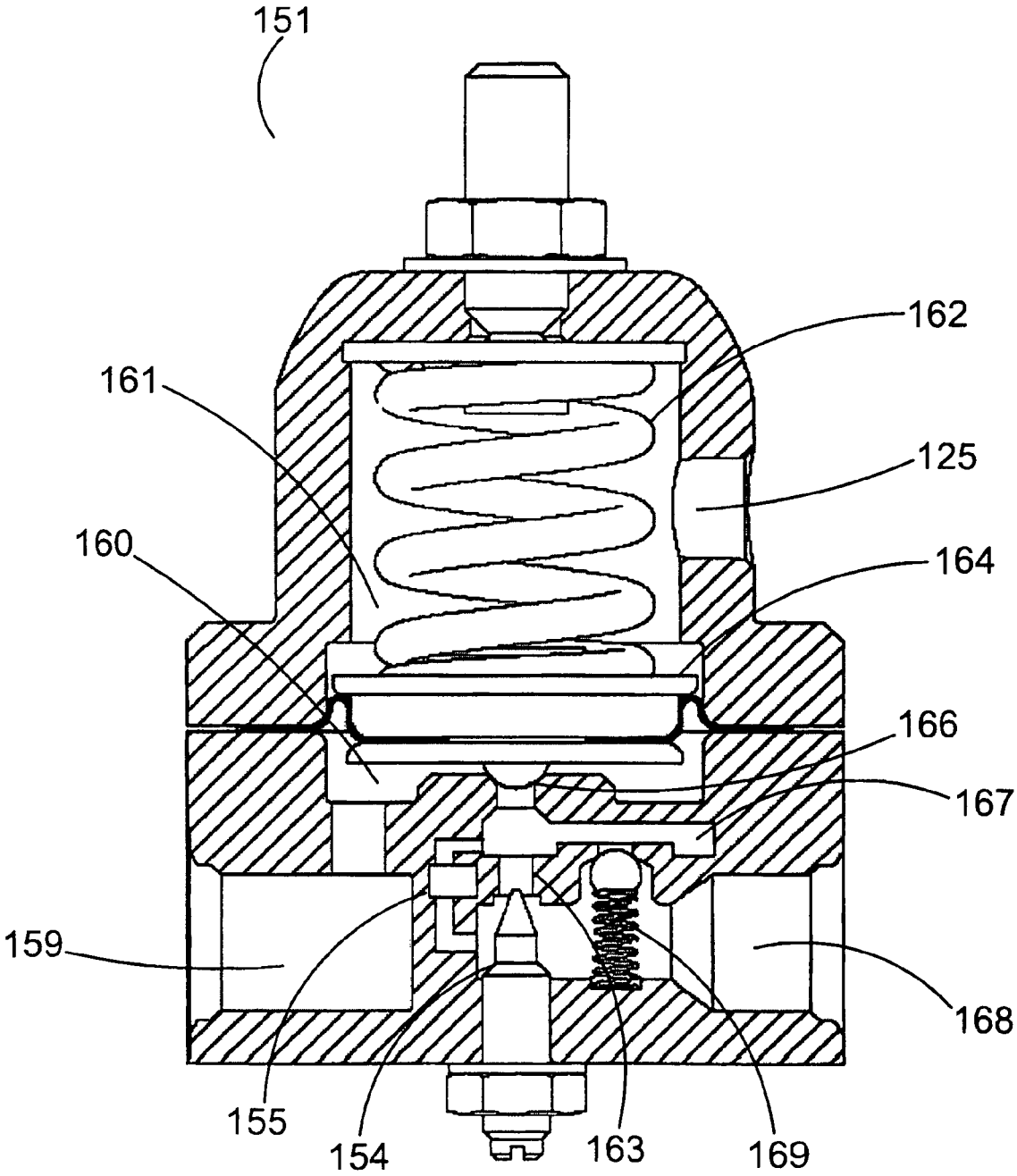
FIG. 4 is a sectional elevation view of a preferred embodiment return-flow electronic fuel pressure regulator of the present invention and disclosed in the embodiment fuel system of FIG. 3.

To provide for differential pressure analysis, fuel pressure regulator 151 is fluidly connected to fuel rail 106 and engine intake manifold 110. In this respect line 109 delivers excess fuel from fuel rail 106 to regulator 151. Additionally, regulator 151 is plumbed to engine intake manifold 110 via vacuum line 125. By virtue of vacuum line 125, the pressure control system can adjust fuel pressure for changing intake manifold pressures, thus creating a relatively constant pressure drop across fuel injectors 105. As shown in FIG. 4 the return-flow electronic fuel pressure regulator 151 includes adjustable flow restrictor 154 and integral comparative pressure sensing means 155 disposed between return reservoir 167 and return chamber 168. In a preferred embodiment, comparative pressure sensing means is an integral dual-input pressure transducer 155. In a preferred embodiment adjustable flow restrictor 154 is a needle valve. In an alternative embodiment adjustable flow restrictor could be a changeable orifice. Pressure transducer 155 measures the pressure drop created by flow restrictor 154 and outputs a signal based upon that measurement. ECM 121 receives and analyzes the output from pressure transducer 155. In accordance with this output, ECM 121 outputs a fuel pump speed control signal to adjust speed of the pump to maintain a determined value of pressure transducer reading. For example, when a measured pressure drop is too low, ECM 121 outputs a speed control signal to speed up pump 103. When measured pressure drop readings are too high, ECM 121 outputs a signal to slow down pump 103. This action allows a continuous and consistent return of fuel. In the embodiment fuel system shown, the returning fuel flow rate is relatively small in comparison with the prior art fuel system.

FIG. 4 shows a preferred embodiment return-flow electronic fuel pressure regulator 151 of the present invention and included in the fuel system depicted in FIG. 3. Its structure and operation is described as follows. Fuel from fuel rail 106 flows via line 109 and into fuel intake chamber 159. Fuel entering intake chamber 159 flows on into fuel fill chamber 160 with low restriction. It will be appreciated that chamber 160 of regulator 151 is in essential fluid communication with fuel rail 106 and therefore the pressure of fuel in chamber 159 will equate to the pressure of fuel in fuel rail 106. Air chamber 161 is plumbed into (in fluid communication with) engine intake manifold 110 via vacuum line 125. Fuel enters intake chamber 159 from fuel rail 106 and passes with minimal restriction on in to expansible fill chamber 160, one wall of which is defined by diaphragm assembly 164. Expansible fuel fill chamber 160 and air chamber 161 are on opposite sides of diaphragm assembly 164. Air pressure in chamber 161 acts upon one side of diaphragm assembly 164 while fuel pressure in chamber 160 exerts a force over the opposite side diaphragm assembly 164 which is opposed by biasing spring 162. When the force of the spring 162 is counteracted by the difference of the fuel pressure in chamber 160 minus air pressure in chamber 161, the diaphragm assembly 164 is allowed to depart its seat 166 allowing fuel to enter return reservoir 167. As fuel flows into return reservoir 167 it passes through passage 163 on into return chamber 168. Adjustable needle valve 154 restricts the flow of fuel through passage 163. Fuel entering chamber 168 is allowed to return back to the tank 102. Pressure transducer 155 measures the differential pressure (pressure drop) between return reservoir 167 and chamber 168 and outputs a signal to ECM 121 based upon that measurement. To protect pressure transducer 155 from high differential pressures (such as might be caused when the throttle is suddenly let off to idle during high engine demand) and allow high flow rates through the valve assembly, the preferred embodiment regulator further comprises pressure relief valve 169 between return reservoir 167 and return chamber 168. In the event of engine demand suddenly going to zero differential pressure can become damagingly high. In such a case, pressure relief valve 169 disposed between return reservoir 167 and return chamber 168 will operate to protect transducer 155.

In an alternative embodiment, integral comparative pressure sensing means 155 could constitute two independent transducers each separately reposed in reservoir 167 and chamber 168 and respectively outputting a signal based upon measured fuel pressure in the reservoir and chamber. In such case, ECM 121 would be adapted to receive and analyze the respective outputs of these transducers and output a pump power supply signal based thereon.

It will be appreciated from the above description that, unlike other fuel systems, integral pressure transducer 155 is reading differential pressure between return reservoir 167 and return chamber 168. Hence, the fuel system of the present invention utilizes a comparison of post-regulated fuel pressure to restricted fuel pressure as an available ECM input to control pump speed. Fuel pump speed control is accomplished using a signal from pressure transducer 155 to ECM 121 to control the electronically controlled fuel pump. The fuel system and return-flow fuel pressure regulator of the present invention provide advantages over current fuel management units by being capable of using a comparative post-regulated fuel pressure to control fuel pressure. (Typical fuel management units use only intake manifold pressure.) Using the present invention regulator and fuel system, fuel pressure can more accurately reflect engine fuel demands.

Regulator 151 can be purchased as an aftermarket fuel system component to provide an input to utilize in controlling fuel system pressure. In a fuel system without an electronic fuel management unit, ECM 121 would need to be provided.

In a fuel system with an existing fuel management unit, the fuel management unit could be reprogrammed or reconstructed to receive the output from comparative pressure sensing means 155 and output a fuel pump control signal based upon that transducer output. In another embodiment, the microprocessor electronics comprising ECM 121 could be contained within the housing of the fuel pump itself.

The return-flow electronic fuel pressure regulator with programmed ECM is particularly adapted for aftermarket use. Using a bypass style regulator enables the fuel system to react normally and preserve high-pressure stability, such as is found in return-style fuel systems, while maintaining consistent ability to reduce current draw during low engine demand operating conditions.

As shown in FIG. 3, the preferred embodiment fuel system 100 may further comprise safety relay 400 in electric communication with one or more of the engine management electronics, the fuel pump, ignition system or fuel injectors. The ECM of each preferred embodiment fuel systems may be programmed such that if the value of a measured pressure drop reading from the pressure transducer is too low over a given period of time, safety relay 400 is engaged (via a signal from the ECM) to protect the engine and shut down the fuel system. This action can be used as a safety mechanism to shut down the fuel system or engine in the event of catastrophic fuel system failure. Over a given period of time (typically less than one second) relay 400 can engage and interrupt engine functions to prevent engine damage. For example, if the fuel line 113 fails due to excessive leakage or rupture, safety relay 400 will engage and shut down power to fuel pump 103 or shut down the ignition system.

The present invention fuel system may further comprise one or more electronic devices that output an analog signal as a function of fuel rail pressure, throttle position, engine speed, or fuel injector operation and the electronic control module beings adapted to receive the output analog signals from the one or more electronic devices and output a power supply signal to the fuel pump based upon those analog signals This invention can apply to other hydraulic or fluid pumping systems. This present invention can also be applied to carbureted fuel delivery systems as well. Aerospace applications for both manned and unmanned vehicle systems can apply as well. Other types of industrial and laboratory applications can also apply, as this system also greatly increases efficiency of constant pressure, variable flow hydraulic pumping systems.

What is claimed is:

1. A fuel system for supplying fuel from a tank to a fuel injected engine having an ignition system and air intake manifold, the system comprising:

a fuel tank, a fuel rail, one or more fuel injectors communicating between the fuel rail and air intake manifold, a fuel pump for delivery of fuel from the fuel tank to the fuel rail, a return line from the fuel rail to the tank, a fuel pressure regulator disposed in the return line between the fuel rail and the tank, and an electronic control module;

the fuel pressure regulator having an air chamber, a fuel intake chamber, a fill chamber, a diaphragm assembly disposed between the fill chamber and the air chamber, a return reservoir, a return chamber, an adjustable valve disposed between the return reservoir and the return chamber and comparative pressure sensing means that outputs one or more electric signals based upon the fuel pressures in the return reservoir and the return chamber;

the intake chamber being in fluid communication with the fuel rail;

the fill chamber being in fluid communication with the intake chamber;

the return chamber being in fluid communication with the return line;

the fill chamber having at least one surface defined by the diaphragm assembly, the movement of the diaphragm assembly being regulated by the pressure of fuel in the fuel rail and air pressure in the engine air intake manifold;

the diaphragm assembly permitting the flow of fuel from the fill chamber to the return reservoir based upon the difference in pressure of fuel in the fuel rail and pressure of air in the engine air intake manifold reaching a predetermined point;

the return chamber being in fluid communication with the return reservoir, the flow of fuel from the return reservoir to the return chamber being subject to restriction by the adjustable valve; and the electronic control module being electrically connected to the comparative pressure sensing means and the fuel pump and adapted to receive the one or more electric signals from the comparative sensing means and output a speed control signal to the fuel pump based upon those one or more signals.

2. The fuel system of claim 1 wherein the comparative pressure sensing means comprises a single transducing element adapted to receive pressure inputs from the return reservoir and return chamber and output a unitary signal based upon a comparison of the input signals.

3. The fuel system of claim 1 wherein the comparative pressure sensing means comprises two independent transducers that output an electric signal based upon fuel pressure and that are separately disposed within the return reservoir and return chamber.

4. The fuel system of claim 1 wherein the fuel pressure regulator further comprises a pressure relief valve disposed between the return reservoir and the return chamber.

5. The fuel system of claim 1 further comprising a safety relay in electric communication with the electronic control module and also the fuel pump or ignition system.

6. The fuel system of claim 1 wherein the adjustable valve is a needle valve or a changeable orifice.

7. The fuel system of claim 1 further comprising one or more electronic devices that output an analog signal as a function of fuel rail pressure, throttle position, engine speed, or fuel injector operation and the electronic control module beings adapted to receive the output analog signals from the one or more electronic devices and output a power supply signal to the fuel pump based upon those analog signals.

8. A fuel pressure regulator for use in a fuel system supplying fuel from a tank to a fuel injected engine, the engine comprising an air intake manifold and the fuel system comprising a fuel tank, a fuel rail, one or more fuel injectors communicating between the fuel rail and air intake manifold, a fuel pump for delivery of fuel from the fuel tank to the fuel rail, a return line from the fuel rail to the tank and an electronic control module electrically connected to the fuel pump, the fuel pressure regulator comprising:

an air chamber, a fuel intake chamber, a fill chamber, a diaphragm assembly disposed between the fill chamber and the air chamber, a return reservoir, a return chamber, an adjustable valve disposed between the return reservoir and the return chamber and comparative pressure sensing means that outputs one or more electric signals based upon fuel pressures in the return reservoir and the return chamber;

the intake chamber being adapted for fluid communication with the fuel rail;

the fill chamber being in fluid communication with the intake chamber;

the return chamber being adapted for fluid communication with the return line;

the fill chamber having at least one surface defined by the diaphragm assembly, the movement of the diaphragm assembly being regulated by the pressure of fuel in the fuel rail and air pressure in the engine air intake manifold;

the diaphragm assembly permitting the flow of fuel from the fill chamber to the return reservoir based upon the difference in pressure of fuel in the fuel rail and pressure of air in the engine air intake manifold reaching a predetermined point;

the return chamber being in fluid communication with the return reservoir, the flow of fuel from the return reservoir to the return chamber being subject to restriction by the adjustable valve; and the comparative pressure sensing means being adapted for electrical connection to the electronic control module.

9. The fuel pressure regulator of claim 8 wherein the comparative pressure sensing means comprises a single transducing element adapted to receive pressure inputs from the return reservoir and return chamber and output a unitary signal based upon a comparison of the input signals.

10. The fuel pressure regulator of claim 8 wherein the comparative pressure sensing means comprises two independent transducers that output an electric signal based upon fuel pressure and that are separately disposed within the return reservoir and return chamber.

11. The fuel pressure regulator of claim 8 wherein the fuel pressure regulator further comprises a pressure relief valve disposed between the return reservoir and the return chamber.

12. The fuel pressure regulator of claim 8 wherein the adjustable valve is a needle valve or a changeable orifice.

* * * * *